US005087209A

United States Patent [19]

Faucher

[11] Patent Number: 5,087,209

[45] Date of Patent: Feb. 11, 1992

[54] ELECTRICAL PLUG AND SOCKET ARRANGEMENT

[76] Inventor: Raymond G. Faucher, 9470, Grondin Avenue, Charlesbourgh, Quebec, G1G 5L2, Canada

[21] Appl. No.: 666,700

[22] Filed: Mar. 8, 1991

[51] Int. Cl.[5] ..... H01R 4/38

[52] U.S. Cl. ..... 439/320; 439/218

[58] Field of Search ..... 439/166, 170, 312, 313, 439/320, 321, 322, 323, 217, 218, 253

[56] References Cited

U.S. PATENT DOCUMENTS 2,404,682 7/1946 Baker ..... 439/320
3,573,712 4/1971 Shirey ..... 439/322
4,808,127 2/1989 Swanic ..... 439/320 X

FOREIGN PATENT DOCUMENTS 3500172 7/1985 Fed. Rep. of Germany ..... 439/321
0246921 2/1964 Netherlands ..... 439/322

*Primary Examiner*—Neil Abrams
*Assistant Examiner*—Khiem Nguyen
*Attorney, Agent, or Firm*—Roland L. Morneau

[57] ABSTRACT

An electric plug and socket arrangement includes a connecting sleeve threadedly engaging the plug to the socket. The sleeve is slidingly mounted on the plug or on the socket and can slide to completely clear their abutting face so that the plug or the socket may be used with conventional plugs and sockets.

1 Claim, 2 Drawing Sheets

ELECTRICAL PLUG AND SOCKET ARRANGEMENT

FIELD OF THE INVENTION

The present invention relates to an electrical plug and socket arrangement such as the ones used to join conventional extension cords or the like and more particularly to a plug and socket arrangement having a retractable connector for retaining both the plug and the socket together.

The retractable connector allows either elements of the novel combination to be used with a conventional corresponding plug or socket when needed.

BACKGROUND OF THE INVENTION

Conventional extension cords are provided at one of their end portions with a male plug having prongs and at the other end portion with a socket having bores adapted to receive prongs from another male plug.

In certain instances, a plurality of extension cords must be joined end to end to form a chain which will allow the user to obtain a desirable extension cord length. In these situations, any type of pulling action or other movement imparted on a section of the chain is susceptible of retracting the male prongs of a given extension cord from the corresponding bores into which they were initially inserted.

Once, one or more prongs are partially retracted from the corresponding bores into which they were initially inserted, not only is the flow of electrical current to the appropriate location interrupted but the situation also creates a potential serious hazard since the prongs become exposed to the environment and there is a possibility of short-circuiting, sparks, etc. . . .

A number of structures have been proposed to minimize such risks. U.S. Pat. No. 2,753,534 and 2,945,203 both disclose connectors that employ a threaded sleeve to connect two elements together in order to prevent the plug and socket members from separating. Such structures, however, present a major drawback. Even if the prongs and bores of these connectors were compatible with the corresponding prongs and bores of conventional plugs and sockets, the described socket elements could not be independently connected to any conventional plug and the described plug member could not be connected to any conventional socket. In both patents, the described structure comprise a rotatable, internally threaded sleeve on the plug side of the connector and a corresponding annular externally threaded ring on the socket side of the connector.

Both the sleeves and the rings form a physical obstacle which prevent insertion into conventional plugs and sockets. The threaded sleeve is laterally fixed to the plug side to physically and electrically protect the prongs.

Accordingly, the present invention provides a plug and socket arrangement which has an integral connector for retaining both the plug and the socket together.

The connector is slidingly mounted on one of the elements of the combination thus allowing either the novel plug or socket to be used independently with commercially available components. This advantage could prove to be particularly useful when one of the two parts of the novel combination fails to operate properly and one must rely on available conventional plug or sockets.

SUMMARY OF THE INVENTION

The present invention relates to electrical plug and socket adapted to be releasably secured together, in a longitudinal axial direction. The plug has a cylindrical body, a substantially flat abutting face and a plurality of prongs orthogonally projecting outside the abutting face. The cylindrical body has a peripheral threaded portion adjacent the abutting face. The socket has a cylindrical body, a substantially flat abutting face defining a plane and a plurality of bores adapted to receive the prongs to allow the abutting faces of the plug and the socket to substantially contact each other. The cylindrical body of the socket has successively a ring-like peripheral wall and recess adjacent the abutting face of the socket. The socket also has a ferrule with an internal cylindrical surface comprising a threaded portion adapted to threadally engage the threaded portion of the plug and an inwardly beaded ring adapted to rotate and sideways slide into the recess. The wall as an outer diameter sufficiently large to maintain the beaded ring inside the recess. The recess has a width sufficient to allow the ferrule to slidingly recede over the cylindrical body of the socket to completely clear the plane of the abutting face of the latter.

DESCRIPTION OF THE PREFERRED EMBODIMENT

Figure 1:
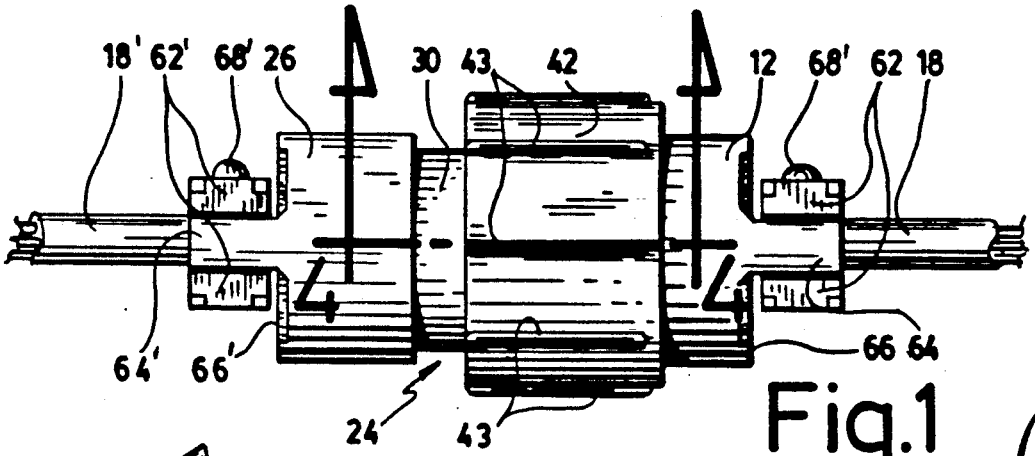
FIG. 1 is an elevation view of a plug and socket arrangement according to the invention.
Figure 2:
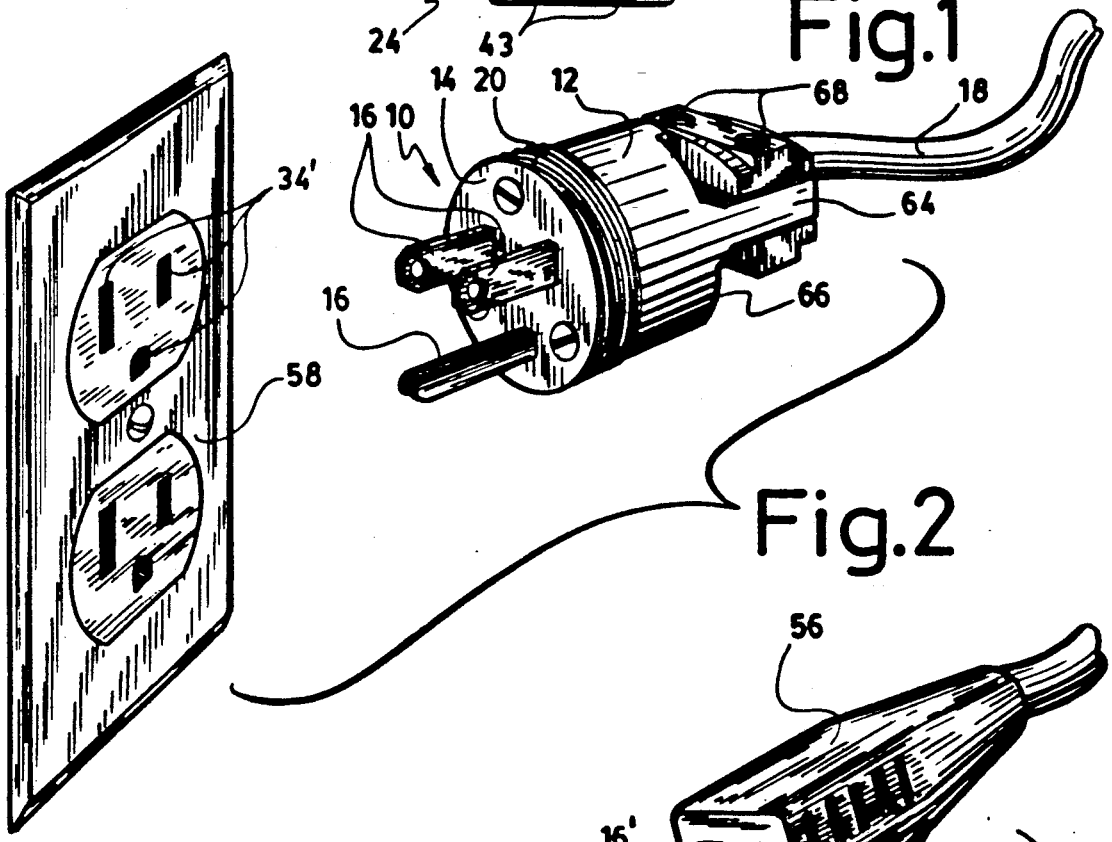
FIG. 2 is a perspective view illustrating the plug of the novel arrangement and a conventional wall socket adapted to be suitably connected together.

Referring to FIG. 2, there is shown a plug 10 having a cylindrical body 12, a substantially flat abutting face 14 and a plurality of prongs 16 orthogonally projecting outside the abutting face 14.

The prongs 16 are electrically linked to a set of wires (not shown) protected by a cable sheating 18. The cylindrical body 12 has peripheral external threads 20 adjacent the abutting face 14.

Figure 4:
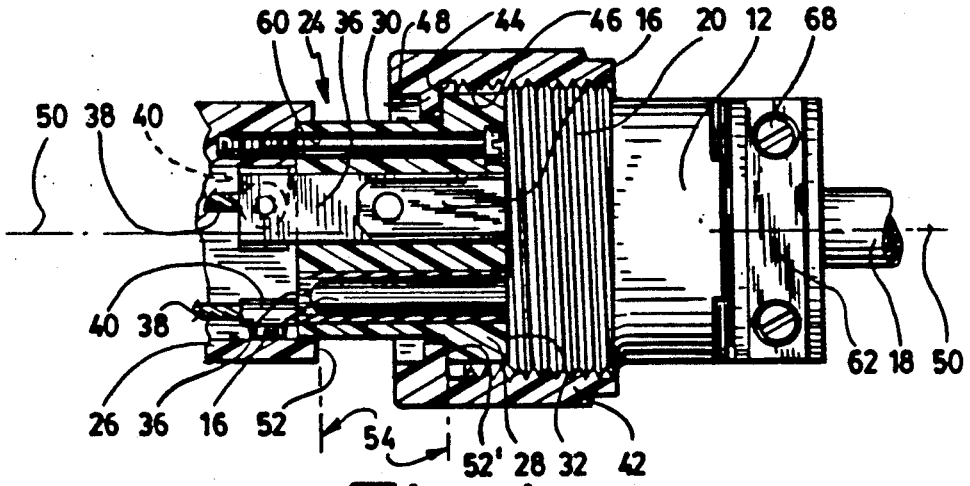
FIG. 4 is a longitudinal cross-sectional view taken along line 4—4 of FIG. 1.

Referring now more specifically to FIG. 4, there is shown a socket having a cylindrical socket body 24. The body 24 is divided into a first ring-like section 26 adjacent the abutting face 14 and separated by a second ring-like section 28 by a cylindrical recess 30.

The body 24 has a substantially flat abutting face 32 provided with bores 34. The bores 34 are sheathed with a conductive sleeve 36 adapted to receive the prongs 16. The sleeves 36 are electrically connected to a series of electrical wires 38 by a connecting component 40.

A ferrule 42 is slidably and rotatably mounted on the socket body 24 and forms part of the socket in the present embodiment. The ferrule 42 has an inner cylindrical surface 44 provided with internal threads 46. The internal threads 46 are adapted to threadedly engage the external threads 20 of the plug thus preventing separation of the plug from the socket. The ferrule 42 is also provided with an inwardly beaded ring 48. The ring 48 is adapted to slide parallel to a longitudinal axis 50 inside the recess 30 and to abut at both extremities of axial displacement against abutting walls 52 and 52', thus limiting the axial movement of the ferrule 42.

The length characterized by the distance 54 of recess 30 corresponds to the distance the ferrule 42 can slide. The ferrule 42 is adapted to recede over the cylindrical body 24 of the socket to completely clear the abutting face 32.

Figure 3:
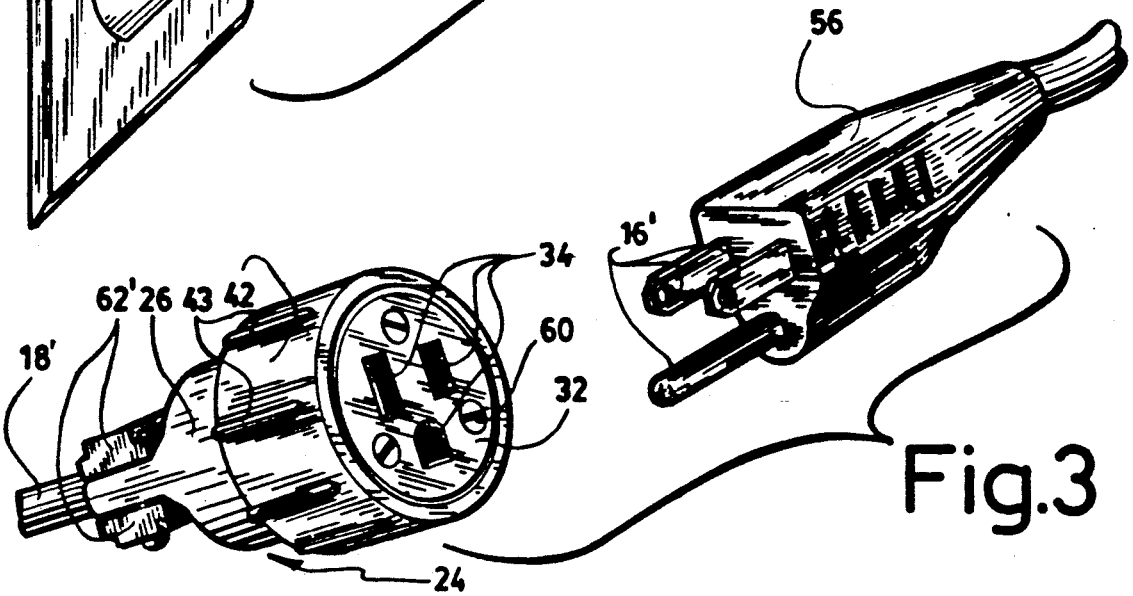
FIG. 3 is a perspective view of the socket of the novel arrangement and a conventional electrical cord plug adapted to be suitably connected together.

As illustrated in FIG. 3, the socket with the ferrule 42 in a fully retracted position can be used with any corresponding conventional plug such as conventional plug 56 having prongs 16'. As can be seen in FIG. 2, the novel plug can also be used with conventional equipment such as wall socket 58 wherein the prongs 16 fit in the bores 34' until the face 14 abuts against the socket 58.

Figure 5:
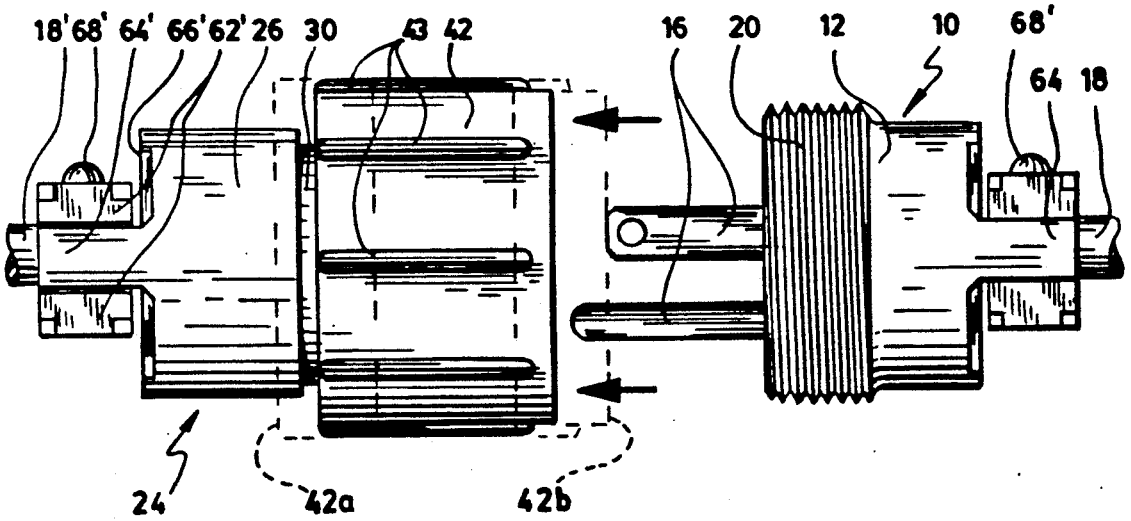
FIG. 5 is an elevation view of the novel plug and socket arrangement with the plug about to be inserted in the socket and the ferrule in an intermediate slidden position.

Referring to FIG. 5, the dotted line **42*a* illustrates the back of the ferrule 42*a* in a fully retracted position while line 42*b* illustrates the front of the ferrule 42** in a forwardly projected position.

The ferrule 42 is provided on its outer periphery with a set of prehension ribs 43 adapted to provide abutting means for the fingers of a user when the ferrule is rotated.

In the preferred embodiment, the socket body is manufactured in two separate parts. Referring back to FIG. 4, the second ring-like section 28 and the cylindrical recess 30 are made from a single piece of material attached to the first ring-like section 26 with a set of screws 60.

The preferred embodiment also includes a double pair of jaw-like components 62 adapted to secure the electric cables 18 to the socket and to the plug. The socket and the plug 10 have a pair of fixing prongs 64' and 64 respectively which extend integrally from their back surfaces 66' and 66. Each pair of jaw-like components 62 and 62' has a pair of screws 68 and 68' which extends through the respective fixing prongs 64 and 64' and which are adapted to squeeze the components 62 and 62' together. The components 62 and 62' are thus adapted to squeeze the cables sheating 18 and 18' respectfully and releasably attach them to either the plug or the socket.

An alternative embodiment of the invention also provides means for securing the novel plug and socket together while allowing compatibility with conventional components. In this alternative embodiment, the ferrule and the associated structural components are located on the plug while the external threads are located on the socket. This alternative embodiment also allows the prongs 16 to clear the abutting face 14 and to be used on a wall socket as in FIG. 2.

I claim:

1. An electrical plug and socket adapted to be releasably secured together in an axial longitudinal direction, said plug having a cylindrical body, a substantially flat abutting face and a plurality of prongs orthogonally projecting outside said abutting face, said cylindrical body having a peripheral threaded portion adjacent said abutting face, said socket having a cylindrical body having a first ring-like section and a second ring-like section, said second section co-axially and partially mounted in said first section and a set of screws longitudinally disposed for removably securing said second section to said first section, said second section having a protuberant ring-like peripheral wall forming a substantially flat abutting face for said socket provided with a plurality of bores adapted to receive said prongs to allow the abutting faces of the plug and the socket to substantially contact each other, a cylindrical recess between said first section and said peripheral wall, a ferrule having an inner cylindrical surface comprising a threaded portion adapted to threadedly engage the threaded portion of said plug and an inwardly beaded ring adapted to rotate and restrictingly slide longitudinally into said recess, said wall having an outer diameter sufficiently large to maintain said beaded ring inside said recess and sufficiently small to allow said threaded portion to longitudinally slide thereover, said recess having a width sufficient to allow ferrule to slidingly recede over the second section of the socket to completely clear the plane of the abutting face of the second section, whereby said ferrule is adapted to be mounted over said second section by separating, with the removal of said screws, the second section from the first section for introducing the ferrule over said second section.

* * * * *